US009546026B2

(12) United States Patent
Drugeon et al.

(10) Patent No.: US 9,546,026 B2
(45) Date of Patent: Jan. 17, 2017

(54) PACKAGING AND APPLICATOR DEVICE USING A PIPETTE

(75) Inventors: Lionel Drugeon, La Garenne Colombes (FR); Thierry Ramboz, Sannois (FR); Jean-Francois Delage, Clamart (FR); Jean-Marc Lebrand, Pantin (FR)

(73) Assignee: L'OREAL, Paris (FR)

( * ) Notice: Subject to any disclaimer, the term of this patent is extended or adjusted under 35 U.S.C. 154(b) by 940 days.

(21) Appl. No.: 13/702,155

(22) PCT Filed: Jun. 7, 2011

(86) PCT No.: PCT/EP2011/059375
§ 371 (c)(1),
(2), (4) Date: Apr. 18, 2013

(87) PCT Pub. No.: WO2011/154397
PCT Pub. Date: Dec. 15, 2011

(65) Prior Publication Data

US 2013/0192713 A1 Aug. 1, 2013

Related U.S. Application Data

(60) Provisional application No. 61/385,573, filed on Sep. 23, 2010.

(30) Foreign Application Priority Data

Jun. 7, 2010 (KR) ..... 10-2010-0053225
Sep. 17, 2010 (FR) ..... 10 57455

(51) Int. Cl.
*B65D 47/00* (2006.01)
*B65D 50/04* (2006.01)
(Continued)

(52) U.S. Cl.
CPC ..... *B65D 47/00* (2013.01); *A45D 34/04* (2013.01); *B01L 3/0282* (2013.01); *B65D 50/046* (2013.01); *B65D 51/32* (2013.01)

(58) Field of Classification Search
CPC ..... B01L 3/0282; A45D 40/26; A45D 34/00; A45D 34/04; B65D 51/32; B65D 50/046
(Continued)

(56) References Cited

U.S. PATENT DOCUMENTS 4,278,360 A 7/1981 Lorscheid et al.
4,573,503 A * 3/1986 Bruhn ..... B43L 25/00 141/24
(Continued)

FOREIGN PATENT DOCUMENTS

BE 493795 6/1950
EP 0 006 513 1/1980
(Continued)

OTHER PUBLICATIONS

English translation of JP2594962, "Dropper Container", Hiroshi Mizushima et al., Translated by FLS, Inc. in Sep. 2015.*
(Continued)

*Primary Examiner* — Timothy L Maust
*Assistant Examiner* — Timothy P Kelly
(74) *Attorney, Agent, or Firm* — The Marbury Law Group, PLLC

(57) ABSTRACT

Packaging and dispensing device comprising a receptacle (2) and a pipette (31) designed to be inserted into the receptacle in order to permit the collection of a dose of product, the pipette being connected to a closure member (3) for closing the receptacle, characterized in that the closure member is provided with a piston pump (28) designed to aspirate the liquid into the pipette during the passage of this closure member from a closed position to an opened position of the receptacle, the pump being equipped with a push
(Continued)

button (5) in order to permit the aspiration of product when the closure member is not in the closed position.

9 Claims, 3 Drawing Sheets

(51) Int. Cl.
*B01L 3/02* (2006.01)
*A45D 34/04* (2006.01)
*B65D 51/32* (2006.01)

(58) Field of Classification Search
USPC .... 141/21–27, 263, 275–276, 278; 422/934; 222/320, 32.1, 336, 630–631, 420; 401/126; 215/216, 225; 220/300
See application file for complete search history.

(56) References Cited

U.S. PATENT DOCUMENTS

| | | | | | |
|---|---|---|---|---|---|
| 4,579,153 | A * | 4/1986 | Goncalves | B01L 3/0282 | 141/23 |
| 6,076,689 | A * | 6/2000 | Vassallo | B65D 41/04 | 215/209 |
| 9,089,868 | B2 * | 7/2015 | Lee | A45D 34/04 | |
| 2005/0070853 | A1 * | 3/2005 | Gatton | A61J 7/0046 | 604/187 |
| 2009/0261007 | A1 * | 10/2009 | Sanchez | A45D 40/00 | 206/385 |
| 2013/0074983 | A1 * | 3/2013 | Choi | A45D 34/04 | 141/23 |
| 2014/0020789 | A1 * | 1/2014 | Duquet | A45D 34/04 | 141/24 |
| 2014/0234007 | A1 * | 8/2014 | Lee | A45D 34/00 | 401/121 |
| 2014/0361047 | A1 * | 12/2014 | Lee | B65D 41/56 | 222/372 |
| 2015/0144663 | A1 * | 5/2015 | Noel | A45D 34/00 | 222/383.1 |

FOREIGN PATENT DOCUMENTS

| | | | | |
|---|---|---|---|---|
| EP | 0 248 345 | | 12/1987 | |
| FR | 2 549 015 | | 1/1985 | |
| FR | 2 924 696 | | 6/2009 | |
| JP | 7-17757 | U | 3/1995 | |
| JP | 2594962 | Y2 * | 5/1999 | B65D 51/32 |
| WO | 00/18453 | | 4/2000 | |
| WO | 20091048224 | | 4/2009 | |

OTHER PUBLICATIONS

International Search Report from corresponding International Patent Application No. PCT/EP2011/059375, dated Aug. 24, 2011.
The Written Opinion from the International Searching Authority from corresponding International Patent Application No. PCT/EP2011/059375, dated Aug. 24, 2011.

* cited by examiner

PACKAGING AND APPLICATOR DEVICE USING A PIPETTE

This is a national stage application of PCT/EP2011/059375, filed internationally on Jun. 7, 2011, which claims priority to Korean Application No. 2010-0053225, filed Jun. 7, 2010, French Application No. 1057455, filed Sep. 17, 2010, and U.S. Provisional Application No. 61/385,573, filed Sep. 23, 2010.

The present invention relates to a device for packaging a fluid composition and for dispensing the fluid composition using a pipette. The invention has a use more particularly in the field of devices for packaging cosmetic products, from which devices the product has to be delivered in the form of doses.

A "cosmetic product" is understood as a product as defined in Council Directive 93/35/EEC of 14 Jun. 1993.

In the prior art, the document EP-0248345 discloses a packaging and applicator device comprising a receptacle and a closure member, the closure member being equipped with a pipette that is provided at its dispensing end with an applicator member such as a brush. This device discloses pulling on a piston arranged in the pipette in order to charge the latter with a dose of product and, in a second stage, unscrewing the closure member in order to permit application of this dose. The person using such a device is faced with the problem of having two successive maneuvers to perform, one involving pulling on the piston, followed by unscrewing.

Similarly, the user who applies a product by means of a device as disclosed in the document WO2009/048224 is faced with the same problem of two maneuvers, the dose in this case being charged by manipulation of a bulb.

From the disclosure of document FR-2924696, a packaging and applicator device is known by which it is possible, in a single maneuver, to detach the closure member from the receptacle and at the same time to charge a tubular portion connected to the closure member. Product is held in this tubular portion by capillarity. This type of device also poses a problem insofar as it permits only the charging of tiny quantities of product, and it is necessary to return the closure member to its fully closed position in order to permit the recharging of the tubular portion. Moreover, this device also permits only the dispensing of tiny doses by capillarity with the support on which they are to be deposited.

There is therefore a need for packaging and applicator devices permitting the collection of at least one dose, without a specific maneuver by the user when opening the receptacle. Moreover, there is a need for such devices to permit recharging of the pipettes, which are connected to the closure members, without having to return the closure member to a closed position of the receptacle. Finally, there is a need for the pipette to be at least partially emptied of the dose that it contains when the closure member is returned to the closed position on the receptacle.

The object of the invention is to solve at least one of the abovementioned problems by making available a packaging and dispensing device comprising a receptacle and a pipette designed to be inserted into the receptacle in order to permit the collection of a dose of product, the pipette being connected to a closure member for closing the receptacle, characterized in that the closure member is provided with a piston pump designed to aspirate the liquid into the pipette during the passage of this closure member from a closed position to an opened position of the receptacle, the pump being equipped with a push button in order to permit the aspiration and expulsion of product when the closure member is not in the closed position.

Thus, the user does not have to perform excessive maneuvers: simply opening the packaging device gives access to a pipette already charged with product.

Opened position covers the position of the closure member that has no longer any contact with the receptacle and also an intermediate position of the closure member on the receptacle, this intermediate position being characterized in that a simple manual traction, exerted on a free end of the closure member when the latter is in this intermediate position, allows them to be disconnected from each other. The opened position also covers the positions in which the closure member can be detached from the receptacle by simple relative movement in translation. It can in fact be said that the closed position is characterized by the cooperation of connection means carried by the closure member with complementary connection means carried by the receptacle. A detachable position can be characterized by the absence of cooperation between these respective connection means.

Advantageously, the closure member can be designed such that the passage from the closed position to the opened position causes a movement of the piston and aspiration of liquid.

The push button can be kept in a retracted position relative to the closure device when the latter occupies the closed position on the receptacle. This therefore avoids any accidental actuation and excessive charging of the pipette when the device is in the closed position. Advantageously, the return to the closed position, and also the return of the push button to a retracted position, allows at least some of the product contained in the pipette to be ejected back into the receptacle. Thus, most of the product remaining to be dispensed is located homogeneously in the receptacle, outside the pipette.

The closure member can comprise a thread for cooperating with a complementary thread of the receptacle, such that the rotation of an outer casing of the closure member relative to the receptacle can cause the axial translation of the push button relative to this casing.

The rotation of the outer casing of the closure member relative to the receptacle can cause, concomitantly, i.e. simultaneously, the unscrewing of the closure member relative to the receptacle and the axial translation of the push button relative to the outer casing. This translation of the push button can bring it into a protruding position permitting its actuation and therefore a pumping action. If appropriate, in order to completely detach the closure member from the receptacle, additional unscrewing has to be performed, which no longer causes any movement of the push button, the latter having been able to reach its maximum position of protrusion at an intermediate step of this unscrewing.

The closure member can comprise a screw ring having a longitudinal guide ramp so as to immobilize the outer casing in terms of rotation relative to this screw ring, while at the same time permitting the translation of the outer casing relative to the screw ring, and the translation of the push button relative to this outer casing. When the outer casing is driven in rotation relative to the receptacle, the screw ring is driven in translation relative to the receptacle, and for this reason the push button, potentially movable in translation relative to the screw ring, is driven in translation relative to the outer casing.

A mechanical drive mechanism is thus obtained allowing a rotation movement to be converted into a translation movement by means of three components, namely an outer casing, a screw ring and a receptacle.

The outer casing can be connected by a transverse web to an inner tubular portion, the transverse web cooperating with the guide ramp of the screw ring in order to guide the translation.

Alternatively, the receptacle can be provided with a flexible tab equipped with a hook that can engage with a snap fit on the closure member, in order to keep the latter in the closed position, and such that a pushing-in of this flexible tab relative to the receptacle permits the disengagement of the closure member, which then occupies an intermediate position relative to the receptacle. In this intermediate position, the closure member can be detached from the receptacle by simple traction.

In particular, in the case where the device has a main axis of extension, the flexible tab is designed in such a way that a radial pressure exerted on this tab relative to the device permits the disengagement of the closure member.

The push button can be connected to a piston inserted slidably inside a zone of this inner tubular portion. The pipette can be mounted in the continuation of this inner tubular portion.

The push button can be held on the screw ring with a snap fit.

A spring can be tensioned between the push button and the outer casing in order to keep the push button in a fixed axial position relative to the screw ring in the absence of pressure exerted on the push button by a user.

The free end of the pipette can be equipped with an applicator member, like for example a foam applicator, or a comb applicator, or a felt applicator, or any suitable applicator that render the application of the liquid on the skin or the hair more cosmetically acceptable.

The invention will be better understood on reading the following description and examining the accompanying figures. These figures are given solely by way of example and do not in any way limit the invention. In the figures.

Figure 1:
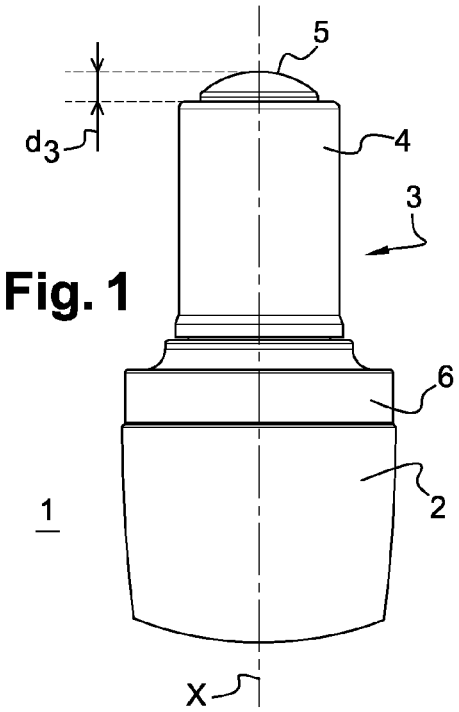
FIG. 1 shows a profile view of a device according to the invention in a closed position.

FIG. 1 shows a device 1 for packaging and dispensing a product. The product contained is preferably a cosmetic product such as a care cream, a day cream or an antiwrinkle cream. The product is in fluid form, preferably liquid. The device 1 comprises a receptacle 2 for containing and storing the product before it is sold on the market and, subsequently, during its period of use by a user.

To preserve the contained product, the receptacle is closed by a closure member 3. The closure member 3 comprises an outer casing 4 and a push button 5. The push button 5 is in the retracted position in FIG. 1. It protrudes very little axially, along a longitudinal axis X, relative to the outer casing 4. Alternatively, in this retracted position, it could be completely masked in the outer casing 4.

The receptacle 2 is made of glass, for example, or from a thermoplastic material. It can be obtained, for example, by an extrusion blow molding method. It can also be obtained by assembly of a plurality of components. Its cross section is circular or oval, for example. The receptacle 2 is topped with a trim band 6 for the esthetic appeal and overall design of the device 1. This trim band 6 can be made of a different material in order to create a material or color contrast with at least one of receptacle 2 and outer casing 4. In particular, the outer casing 4 is flush with an edge of the band 6 in the closed position.

Figure 2:
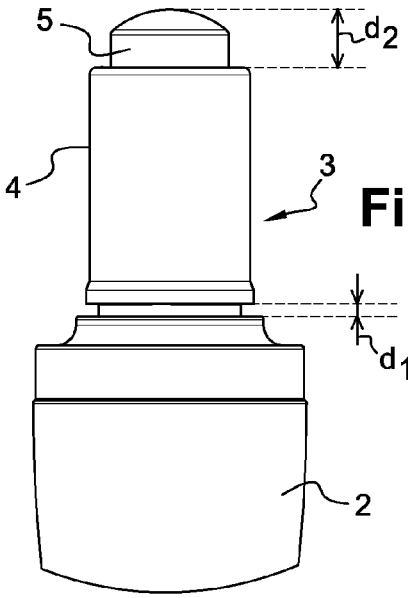
FIG. 2 shows a profile view of a device according to the invention in a position in which the closure member is partly detached from the receptacle.

FIG. 2 shows the device 1 after differential rotation between the outer casing 4 and the receptacle 2. The outer casing 4 has been moved along the axis X, such that it is at a distance d1 from the trim band. In this intermediate position, the push button 5 has another position along the axis X relative to an upper edge 7 of the outer casing 4. It protrudes by a height d2, whereas it protrudes only by a height d3 in the closed position in FIG. 1. The course of the push button is at the maximum of the difference between d2 and d3. This difference between d2 and d3 can be equal to or different than d1. In the example shown, d1 is less than the difference between d2 and d3.

Figure 3:
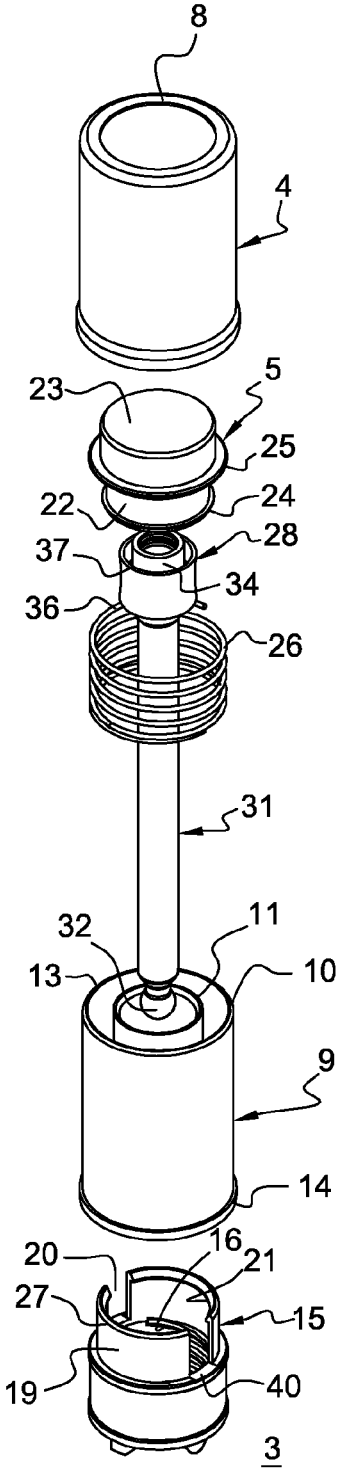
FIG. 3 shows an exploded perspective view of a closure member of a device according to the invention.

FIG. 3 shows an exploded view of the various components that are assembled to form the closure member 3. The outer casing 4 is of tubular shape and, at one axial end, comprises a flange 8 extending radially inward. This outer casing 4 is made of metal, for example, or of a thermoplastic material which, on its outer circumference, can have a lacquering with a metal effect.

The closure member comprises a body 9. This outer casing 4 is mounted on the body 9. The body 9 comprises a first, outer tubular portion 10 and a second, inner tubular portion 11. The two tubular portions 10 and 11 are connected to each other by at least one material bridge 12. The body 9 is preferably produced by injection of a thermoplastic material. The material bridge 12 here takes the shape of two webs transverse with respect to the axis X. These two webs are radially opposite each other about the second, inner tubular portion 11. In the assembled position, an edge 13, at one axial end of the first, outer tubular portion 10, comes into abutment against the flange 8. Along the axis X, at the opposite axial end, this first tubular portion 10 has an area of increased thickness 14 in order to come into tight contact with the inner circumference of the outer casing 4. The outer casing 4 has a fixed axial position relative to the body 9. Alternatively, this fixed axial position can be obtained by gluing or by a snap fit.

The closure member 3 also comprises a screw ring 15. This screw ring 15 has a substantially tubular shape provided locally, on its inner circumference, with a thread 16 designed to cooperate with a complementary thread 17 provided on the outer circumference of the receptacle. In particular, the receptacle 2 comprises a neck 18 having a cross section smaller than the cross section of the housing formed in this receptacle to contain the product. The thread 17 is formed around this neck 18.

The screw ring 15 has a skirt 19 slotted with two diametrically opposite slots 20. The skirt 19 is of substantially tubular shape arranged axially in the continuation of the zone bearing the thread 17. The screw ring 15 is mounted relative to the body 9 in such a way that the transverse webs 12 are respectively arranged in these slots 20, the body 9 being movable in translation relative to the screw ring 15.

The skirt 19 has a beveled protuberance 21 extending radially to the inside of this tubular zone. As the skirt 19 is slotted, this protuberance 21 permits a snap fit on the outer circumference of a complementary component. In this case, the protuberance 21 comes to cooperate with the push button 5. For this purpose, the push button 5 comprises a skirt 22 extending from the circumference of the bearing surface 23 and having a bead 24 which will engage with a snap fit under this protuberance 21. The bead 24 is a continuous annular thread. It can also be discontinuous. It is situated at an axial end of the skirt 22. The bearing surface 23 of the push button 5 here forms a convex dome.

The skirt 22 comprises an annular protuberance 25 extending radially from the outer circumference of the skirt 22. The annular protuberance 25 is arranged at an intermediate distance between the end of the skirt joined to the bearing surface 23 and the other end having the bead 24. The closure member 3 comprises a spring 26, here of helical form. This spring 26 is held between the annular protuberance 25 and the transverse webs 12.

When the various components are assembled and the closure member 3 is not mounted in the closed position on the receptacle 2, the push button 5 is pushed back by the spring 26 such that the annular protuberance 25 is brought into abutment against the flange 8. The contact between the bead 24 and the protuberance 21 makes it possible to limit the axial mobility of the screw ring 15 inside the body 9. In this position, the push button 5 is fully extended from the outer casing 4. If a user pushes the push button 5 in such a way as to push it back inside this outer casing 4, the spring 26 is compressed and the push button slides inside the skirt 19 until a free edge 27 of the protuberance 21 comes into abutment against the annular protuberance 25.

The movement of the push button 5 relative to the outer casing 4 allows product to be pumped into a pipette 31 of the closure member 3. This is because the push button is joined to a piston 28 arranged inside the second, inner tubular portion 11. This inner tubular portion 11 is terminated by a plate 29 which is continued by a channel 30, such that the pipette 31 is retained by the plate 29 of the channel 30 in order to open inside the second, inner tubular portion 11. When the end 32 of the pipette 31 is immersed in a fluid, the movement of the piston 28 in the inner tubular portion 11 permits aspiration of fluid into the pipette 31.

The pipette 31 is, for example, held in the plate 29 by a snap fit. It is made of glass, for example. Alternatively, it can be made of a thermoplastic material. Its end 32 can form a restriction with respect to the inner cross section of the pipette, in order to limit the flow by gravity of the fluid that has been pumped. The restriction allows the product to be held back by capillarity.

Figure 6:
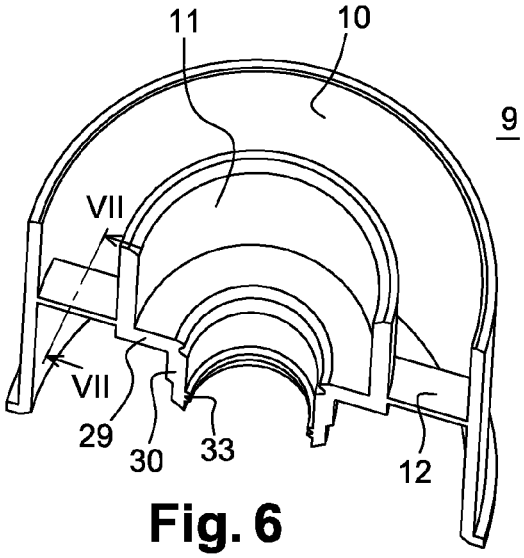
FIG. 6 shows a perspective view, in a longitudinal sectional plane, of a screw ring of a closure member according to FIG. 5.
Figure 7:
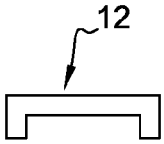
FIG. 7 shows a sectional view on the sectional plane VII-VII indicated in FIG. 6.

As is shown in FIG. 6, the transverse webs 12 are situated substantially at the same axial level as the plate 29. The strength of the body 9 is thereby reinforced. Moreover, as the transverse webs 12 serve as a support for the spring 26, they are strengthened by two areas of increased thickness, as is shown in FIG. 7. These areas of increased thickness result in a U-shaped structure in a sectional plane as shown in FIG. 6. This is because the transverse webs 12 have to withstand the permanent tension of the spring and, more particularly, the excess pressures that will be exerted upon each actuation of the push button 5.

As is shown in FIG. 6, the inner circumference of the channel 30 has a sealing means 33 for making contact with the pipette. This sealing means is formed here by an annular double lip designed to make leaktight contact with the outer circumference of the pipette 31.

The piston 28 is for example made of material, for example of polyethylene. It comprises a tube 34 mounted around a hollow stub 35 of the push button. This hollow stub 35 extends from the bearing surface 23 to inside the skirt 22. The piston 28 comprises two lips 36 and each connected to a flange 38 protruding radially from the tube 34. The lips 36 and 37 are axially opposed along the axis X. They provide double leaktight annular contact with the inner circumference of the second, inner tubular portion 11.

Figure 4:
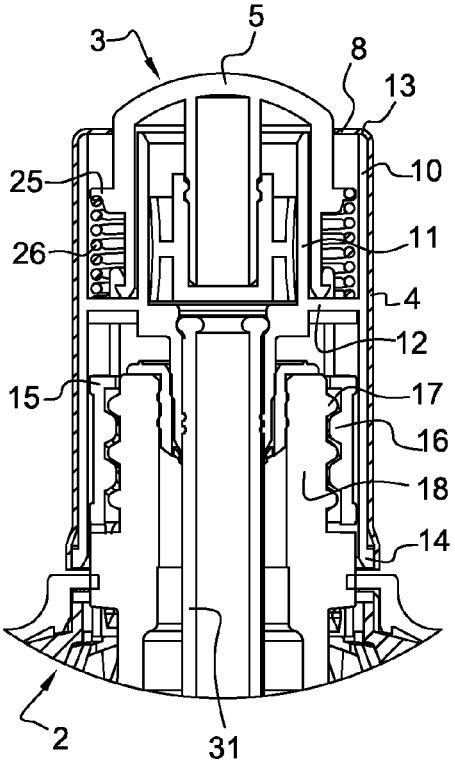
FIG. 4 shows a longitudinal sectional view of the device from FIG. 1.
Figure 5:
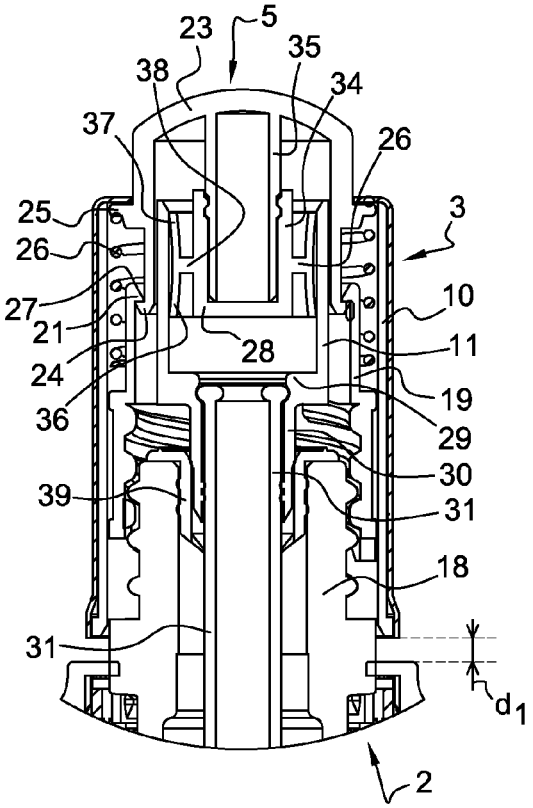
FIG. 5 shows a longitudinal sectional view of the device from FIG. 2.

The closure member 3 is in the closed position in FIG. 4. The screw ring 15 is screwed completely onto the neck 18. The channel 30 is inserted into the neck 18. It comes into leaktight contact with a drier 39 held in the neck. This drier 39 is designed to dry the pipette 31 upon withdrawal of the closure member 3 from the receptacle 2. The screwing of the screw ring 15 on the neck 18 has brought the push button in translation along the axis X, the bead 24 being in contact with the transverse webs 12 in order to limit their movement along the slots 20. The relative movement of the body 9 with respect to the screw ring 15, during the screwing of the closure member 3 on the neck 18, is also limited by the abutment of the sealing lip 36 with the plate 29. In the closed position, the spring 26 is compressed and the push button is in a retracted position relative to the outer casing 4.

During the unscrewing of the closure member 3 relative to the neck 18, this operation being obtained by a rotation of the outer casing 4, immobilized in rotation relative to the screw ring 15, on account of the cooperation between the webs 12 and the slots 20, the body 9 moves along the axis X relative to the screw ring, under the effect of the spring 26. This translation is limited by the abutment between the annular protuberance 25 and the flange 8 and/or by the abutment of the transverse webs 12 with a bottom 40 of the slots 20. The closure member is then in an intermediate position in which the push button has reached its position of use.

In the collection position, the push button 5 protrudes to the maximum extent from the casing 4. However, the unscrewing of the closure member 3 relative to the neck may not be terminated. This is because a first unscrewing moves the closure member from the closed position to this intermediate position, and an additional unscrewing then allows the closure member to be moved from this intermediate position to a position completely detached from the neck 18. The first unscrewing is, for example, by one turn, while the additional unscrewing is by half a turn. The closure member 3 can also be designed to cooperate with the neck 18 in such a way that the intermediate position is the detached position.

Figure 8:
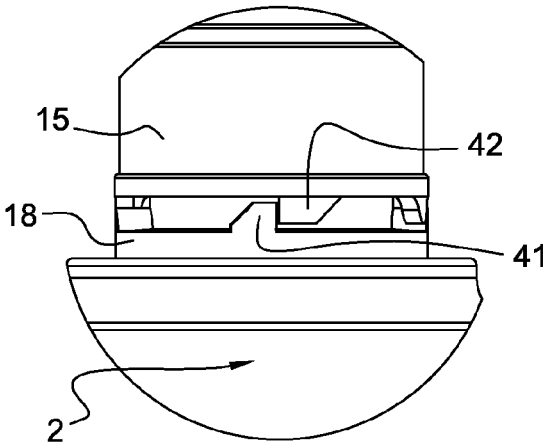
FIG. 8 shows a detailed profile view of a screw ring of a closure member cooperating with a neck of a receptacle of a device according to the invention.

FIG. 8 shows the detail of the screw ring 15 by which it is possible to form an abutment in cooperation with a relief 41 presented by the neck 18. The screw ring has a relief 42 protruding from the tubular zone provided with the thread 16, in a direction axially counter to the protuberance 21. Before reaching this abutment, a flute is provided in order to avoid inopportune unscrewing of the closure member 3, the passage of this flute being able to emit a sound indicating that a correct closure has been reached.

Each actuation of the push button permits collection of a dose of product of the order of several milliliters. The product collected in the pipette 31 is released by driving the push button 5 relative to the outer casing 4.

Figure 9:
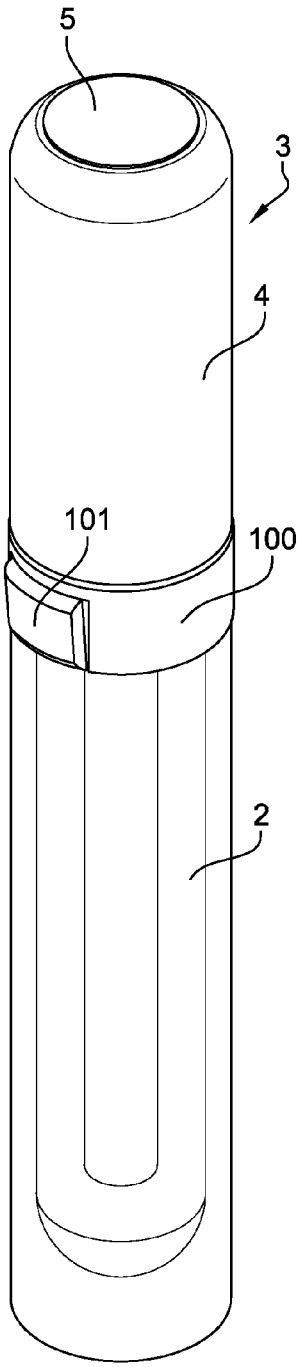
FIG. 9 shows a perspective view of a device according to a second embodiment of the invention in a closed position.
Figure 10:
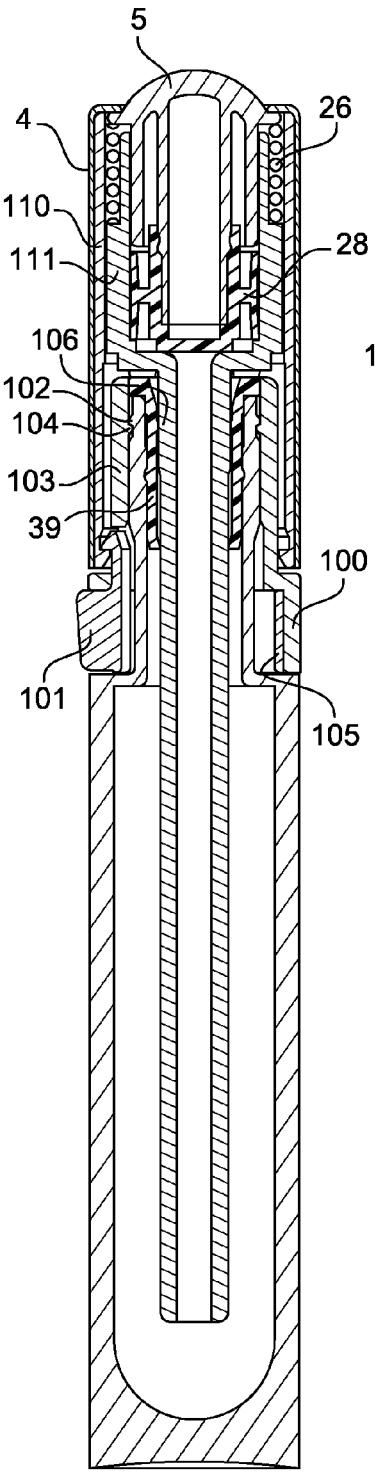
FIG. 10 shows a longitudinal sectional view of the device from FIG. 9.

In the second embodiment, shown in FIG. 9, the receptacle 2 is topped by a ring 100, from which a flexible tab 101 protrudes. This flexible tab 101 cooperates with the closure member 3 in order to keep the latter in the closed position. To obtain the disengagement of the closure member relative to this flexible tab 101, the user has to exert a radial pushing-in pressure until the tab 101 disengages and, under the effect of the thrust of the spring 26, the outer casing 4 of the closure member 3 moves slightly in translation along the axis X.

In this embodiment, the neck is provided with an annular bead 102 instead of the thread provided in the first embodiment described above with reference to FIGS. 1 to 8. The ring 100 comprises a tubular portion 103 engaged around the neck and having a relief 104 on its inner circumference able to cooperate with the annular bead 102 in order to immobilize the ring axially relative to the receptacle 2.

The flexible tab 101 is formed in the jacket surface of the tubular portion 103. The flexible tab 101 comprises a vertical facet carried by a second ring 105 retained axially immobile in the ring 100. The flexibility of this second ring 105 gives the necessary mobility to the vertical facet, allowing the latter to be pushed in radially and permitting its disengagement from a complementary relief.

In this second embodiment, instead of a thread, the closure member 3 comprises an annular recess for cooperating with the flexible tab 101 in the closed position. In particular, this annular recess is formed in a body 109, which is made differently from the body 9 of the first embodiment in the example shown. This is because the body 109 here comprises a first, outer tubular portion 110 that is not connected to a second, inner tubular portion 111, these two tubular portions 110 and 111 being movable in translation here with respect to each other.

Thus, when a user pushes the flexible tab 101 in, the spring 26 retained between the push button 5 and the tubular portion 111 exerts a thrust such that, since the push button is itself in abutment inside the casing 4, it is this casing 4 and the outer tubular portion 110 that are driven in a slight translation movement along the axis X, while the pipette 31 and the inner tubular portion 111 remain in a fixed axial position relative to the receptacle 2.

In this disengaged position, the closure member 3 remains on the receptacle, and a tight annular contact 106 is maintained between the drier 39 and the pipette 31 in order to guarantee a leaktightness that preserves the product even in the case of accidental actuation of the flexible tab 101. When the user places such a device in a handbag, the risks of accidental actuation must not damage the quality of the product that will be subsequently applied.

It is only when the user withdraws the closure member, by exerting a traction in translation relative to the receptacle, that the spring 26 will continue its thrust until the inner tubular portion 111 comes to adopt a second axial position relative to the outer tubular portion 110. For this withdrawal, the user will have to make a slight effort to overcome the frictional force existing between the pipette and the drier. During this relative movement, the piston 28 will be progressively raised inside the inner tubular portion 111, and this will contribute to charging the pipette with liquid. In the fully detached position of the closure member 3, the user will then also have a pipette pre-charged with product.

Figure 11:
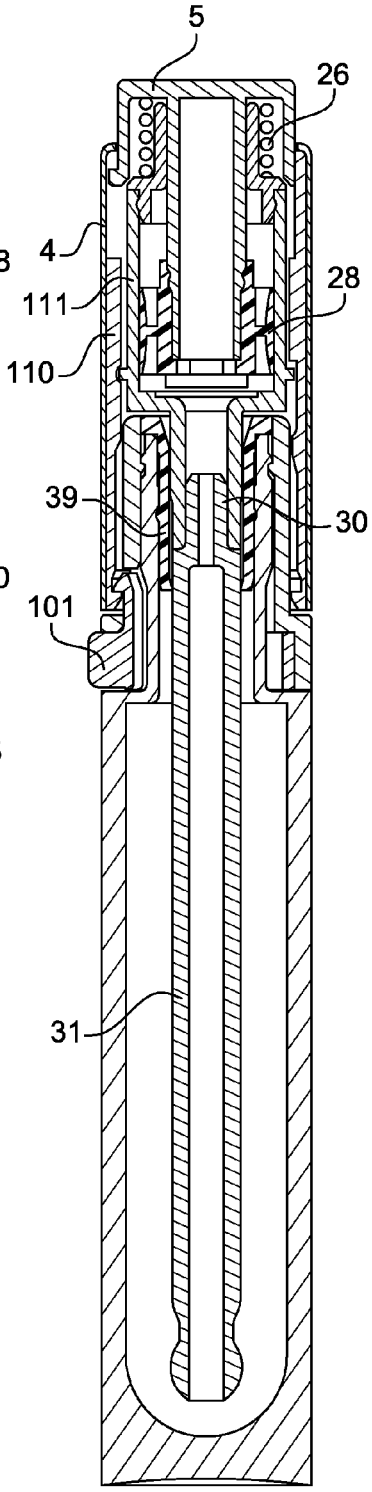
FIG. 11 shows a longitudinal sectional view of an alternative embodiment of the device from FIG. 9.

As can be seen from FIG. 11, the pipette 31 is mounted inside the channel 30 and is inserted from the free end of the channel 30 opposite the inner tubular portion 111.

Throughout the description, the expression "comprising a" is to be considered as being synonymous with "comprising at least one" unless otherwise specified.

The invention claimed is:

1. A packaging and dispensing device comprising:
- a receptacle;
- a pipette;
- a product;
- a closure member comprising a piston pump; and
- a push button;
- wherein the pipette is designed to be inserted into the receptacle in order to permit the collection of a dose of the product,
- wherein the pipette is connected to the closure member for closing the receptacle,
- wherein the piston pump is designed to aspirate liquid product into the pipette during the passage of the closure member from a closed position to an opened position of the receptacle,
- wherein the piston pump is equipped with the push button in order to permit the aspiration of the product when the closure member is not in the closed position; and
- wherein the receptacle is provided with a flexible tab that can engage with an annular recess on the closure member, in order to keep the closure member in the closed position, and such that a pushing-in of the flexible tab relative to the receptacle permits disengagement of the closure member and allows passage to the opened position.

2. The device according to claim 1, wherein the closure member is designed such that the passage from the closed position to the opened position causes a movement of the piston and aspiration of the liquid.

3. The device according to claim 1, wherein the push button is kept in a retracted position relative to the closure member when the closure member occupies the closed position on the receptacle.

4. A packaging and dispensing device comprising:
- a receptacle;
- a pipette;
- a product;
- a closure member comprising a piston pump; and
- a push button;
- wherein the pipette is designed to be inserted into the receptacle in order to permit the collection of a dose of the product,
- wherein the pipette is connected to the closure member for closing the receptacle,
- wherein the piston pump is designed to aspirate liquid product into the pipette during the passage of the closure member from a closed position to an opened position of the receptacle,
- wherein the piston pump is equipped with the push button in order to permit the aspiration of the product when the closure member is not in the closed position;
- wherein the closure member comprises a thread for cooperating with a complementary thread of the receptacle, such that rotation of an outer casing of the closure member relative to the receptacle causes axial translation of the push button relative to the outer casing; and
- wherein the closure member comprises a screw ring having a longitudinal guide ramp so as to immobilize the outer casing in terms of rotation relative to the screw ring, while at the same time permitting translation of the outer casing relative to the screw ring.

5. The device according to claim 4, wherein the rotation of the outer casing of the closure member relative to the receptacle causes, concomitantly, an unscrewing of the closure member relative to the receptacle and the axial translation of the push button relative to the outer casing.

6. The device according to claim 4, further comprising a spring tensioned between the push button and the outer casing.

7. The device according to claim 4, wherein the push button is held on the screw ring with a snap fit.

8. The device according to claim 4, wherein the outer casing is connected by a transverse web to an inner tubular portion, the transverse web cooperating with the guide ramp in order to permit the translation of the outer casing relative to the screw ring.

9. The device according to claim 8, wherein the push button is connected to a piston that is slidably inserted inside a zone of the inner tubular portion, the pipette being mounted in a continuation of the inner tubular portion.

* * * * *